US006213857B1

(12) United States Patent
Duquette

(10) Patent No.: US 6,213,857 B1
(45) Date of Patent: Apr. 10, 2001

(54) SANDING BLOCK

(75) Inventor: David M. Duquette, 1704 Hogar Dr., San Jose, CA (US) 95124

(73) Assignee: David M. Duquette, San Jose, CA (US)

( * ) Notice: Subject to any disclaimer, the term of this patent is extended or adjusted under 35 U.S.C. 154(b) by 0 days.

(21) Appl. No.: 09/439,373

(22) Filed: Nov. 15, 1999

Related U.S. Application Data

(60) Provisional application No. 60/129,354, filed on Apr. 15, 1999.

(51) Int. Cl.[7] ..... B24D 15/00; B24D 17/00

(52) U.S. Cl. ..... 451/513; 451/523; 451/524

(58) Field of Search ..... 451/512, 513, 451/523, 524

(56) References Cited

U.S. PATENT DOCUMENTS 661,282 * 11/1900 Bachman ..... 451/513
2,474,064 * 6/1949 Paul ..... 451/512
2,474,622 * 6/1949 Fleming et al. ..... 451/513
2,493,852 * 1/1950 Bonkowski ..... 451/512
2,531,588 * 11/1950 Stucker ..... 451/512
3,510,991 5/1970 Bowen .
3,601,933 8/1971 Bowen .
4,242,843 1/1981 Phillips .
4,525,959 7/1985 Ziebarth .
4,813,189 * 3/1989 Bolduc ..... 451/513
5,383,308 1/1995 Beloff .
5,387,251 2/1995 Rouse .
5,707,279 * 1/1998 Mitchell et al. ..... 451/512

* cited by examiner

*Primary Examiner*—M. Rachuba

(57) ABSTRACT

An improved sanding block is disclosed for receiving and tensioning a continuous or endless sandpaper loop or other abrasive wrap-around belt about the sanding block's periphery. The block has two parts, so shaped that when assembled within an endless abrasive belt, they provide a wedging action, which effectively elongates or expands the periphery of the tool to properly tension the belt.

5 Claims, 2 Drawing Sheets

SANDING BLOCK

This application claims benefit of provisional application No. 60/129,354, filed Apr. 15, 1999.

BACKGROUND OF THE INVENTION

This invention relates to hand tools and more particularly to a sanding block for hand sanding operations normally used with power belt sanders.

Sanding operations, particularly manual sanding operations for smoothing and abrading metal and wood surfaces, are commonly accomplished by use of cloth or paperbacked abrasive materials. These materials, commonly termed sandpaper, can be used without a sanding block but are generally more efficient and require less effort when used in conjunction with a sanding block. Sanding blocks may simply be a rectangular section of wood, such as a section of a 2×4, to which the sandpaper is applied. Sanding blocks may also be specially configured blocks having a curved resilient surface which receives the paper and has fastening means at opposite ends of the block. The fastening means are generally in the form of a spring or sharp projections, which pierce the sandpaper to secure it in place.

While sanding blocks such as the type described above are convenient to use with sheets or strips of sandpaper. It is also desirable to use abrasive material of the endless belt-type for hand sanding. The endless belt-type sanding material is generally intended for use with power sanders and therefore, is generally more durable having a longer usable life. Also, the endless belt-type of abrasive material has the advantage in that it may be advanced to replace a worn section of the sanding material with an unused section. There are a number of patents in the prior art which relate to appliances or devices for sanding work surfaces that are blocks having several sections or components to accommodate an endless sanding belt. Typical prior art patents representative of devices of this type are the following:

U.S. Pat. No. 3,510,991 shows a sanding block for a continuous loop sanding belt. The block has first and second ends positioned within the belt with cam members positioned between the blocks. The cam members may be adjusted to force the blocks away from one another to secure the sanding belt in place.

U.S. Pat. No. 3, 601,933 shows a sanding block for a continuous loop sanding belt. The block has screw jack elements to loosen and tighten the belt in place.

U.S. Pat. No. 4,242,843 shows a sanding block of the general type shaped to provide a wedging action to tension the belt.

U.S. Pat. No. 4,525,959 disdoses a hand held sanding tool for use with a continuous sanding belt. The tool has a unitary fork member with a removable edge that combine to retain the belt in place. The adjoining planar surfaces are angularly related to facilitate finishing operations.

U.S. Pat. No. 5,383,308 shows a hand held sanding block formed by two blocks of like sections disposed in co-planar relationship. The blocks are freely movable towards and away from each other by means of a pair of spaced dowel pins projecting from one block in telescoping engagement in spring loaded sockets in the other block.

U.S. Pat. No 5,387,251 shows an endless belt sanding block which has a hinge construction.

Known prior art, as exemplified by the above referenced patents, do not provide a simple, inexpensive sanding block. For example, the sanding blocks described in '991,'933, '959,'251, and '308 patents have many parts making them more costly and complicated to manufacture. The '843 patent, although very simple in construction, still requires more than two parts and does not allow for just two identical parts to create an efficient sanding block like the present invention. Furthermore, the '843 patent does not provide a solid backed sanding surface on both the top and bottom surfaces of the sanding block.

SUMMARY OF THE INVENTION

The primary object of the invention is to provide an effective, easy to use and inexpensive sanding block for use with an endless loop sanding belt A related object of the invention is to provide a sanding block consisting of only two interlocking halves which facilitate convenient loading and unloading of abrading material on the sanding block.

Other objects and advantages of the present invention will become apparent from the following descriptions, taken in connection with the accompanying drawings, wherein, by way of illustration and example, an embodiment of the present invention is disdosed.

In accordance with a preferred embodiment of the present invention, a sanding block comprises two interlocking, generally wedge-shaped portions, each wedge-shaped portion having a generally planar surface and a wedge surface non-parallel to the generally planar surface, and the wedge surface of each wedge-shaped portion are constructed to related to each other such that during relative transverse sliding movements outside cross-sectional are is increased.

BRIEF DESCRIPTION OF THE DRAWINGS

The drawings constitute a part of this specification and indude an exemplary embodiment of the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present inverntion may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
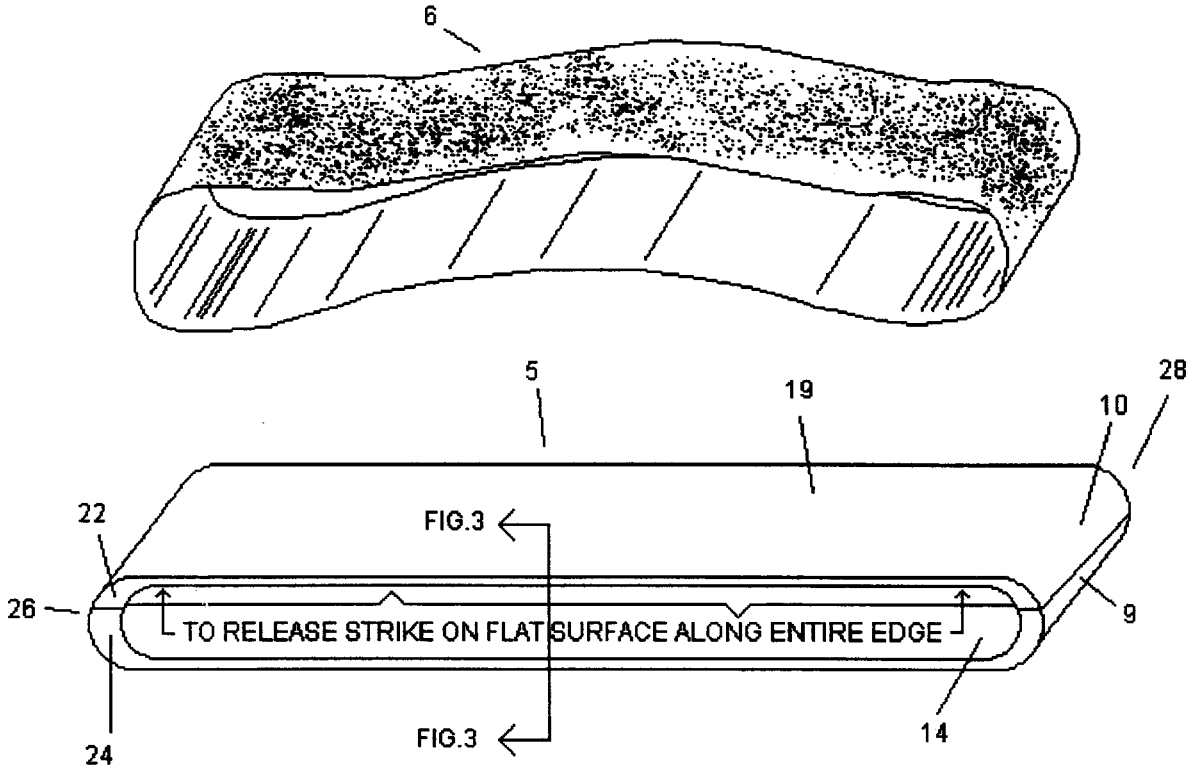
FIG. 1 is a perspective view of the sanding block in accordance with the present invention and an endless loop belt sandpaper strip.
Figure 2:
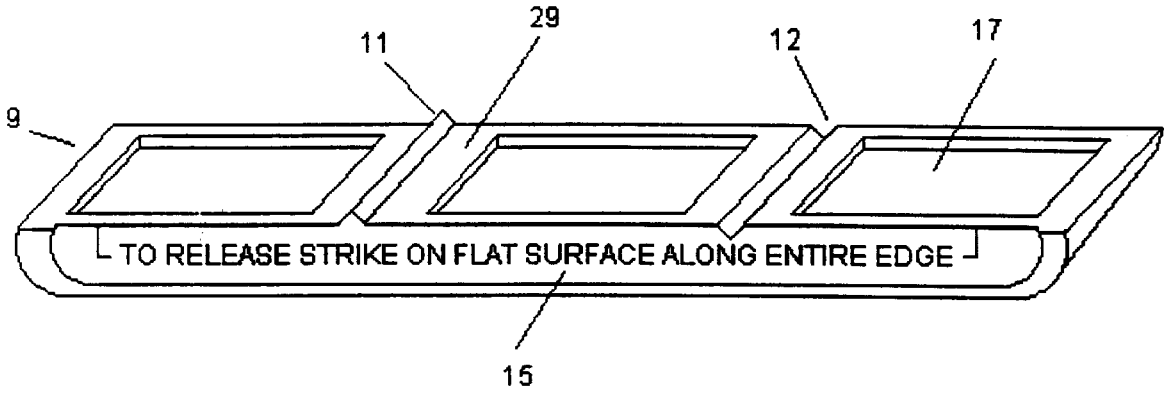
FIG. 2 is a perspective view of one half of the sanding block in accordance with the sanding block of FIG. 1.
Figure 3:
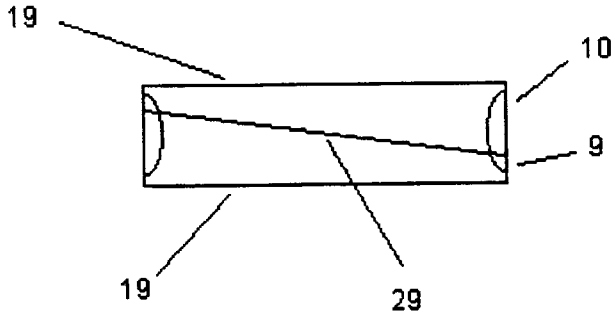
FIG. 3 is a cross-sectional view of the sanding block of FIG. 1 taken along line 3—3.

As shown in FIGS. 1 through 3, the sanding block 5 according to the invention includes two halves 9 and 10 for receiving and tensioning a wrap around, endless abrasive belt 6. Each halve has an uninterrupted generally planar bottom surface 19 and parallel sides 22 and 24. With the sanding block in the assembled position, sides 22, 24 form a generally elongated cavity 14 to receive the thumb and fingers of the user at opposite sides of the block to assist in manual retention and manipulation of the block when sanding. Front end 26 and rear end 28 of the sanding block are convexdy curved to accommodate a standard belt 6 and allow for ease of use with belt 6.

As shown in FIG. 2 each half 9, 10 has an overlying top surface 29 wherein is shown a plurality of voids 17 in the block for the purpose of reducing weight and manufacturing cost. Though the illustrated embodiment is shown with voids 17, voids 17 are not necessary for the operation of the sanding block. Each half on its top surface 29 has a tongue 12 and a groove 11 which are equal distant from the center of the midpoint of the half. This allows the two halves 9 and 10 to be placed together with the top surfaces 29 facing each other, interlocking to form the complete sanding block 5 as shown in FIG. 1. Each half may be printed with instructions 15 located on the surface of cavity 14 to help facilitate the holding and releasing of a continuous sanding belt 6.

Turning now to FIG. 3 there is formed a transversely disposed canted wedge-wall at the two overlying top surfaces 29. The two surfaces 29 are transversely disposed to each other and canted in relation to the bottom surface 19. Top surface 29 is non-parallel to the bottom surface 19.

The assembly and use of the tool should be reasonably apparent from the foregoing descriptions. Assembly is accomplished by sliding the to halves together into the assembled position while wrapped with an endless sanding belt. The transverse sliding movement of the two halves 9 and 10 increases the total circumference around the sanding block and puts tension on the inner surface of the sanding belt When the sides 22, 24 of the two halves 9, 10 become aligned with each other, an appropriate tension will have been applied to the sanding belt, holding it firmly in place. Releasing the sanding belt is accomplished by reversing the same process. As the two halves 9 and 10 are slid apart the total circumference around the sanding block decreases and releases the tension on the sanding belt.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A sanding block for use with a endless sanding belt comprising; two interlocking, generally wedge shape portions, each portion forming a half of the block:each porting having a generally planar sandina surface and a wedge surface which extends longitudinally throuch the sanding block; each wedge portin is contructed such that when both such that when both wedge surfaces are placed into the endless sanding belt and are slid transversely against each other, the outside cross-sectional area is increased, wedging the two portions tight within the belt, holding both firmly in place.

2. The sanding block as daimed in claim 1, further comprising means for interlocking the wedges together.

3. The sanding block as claimed in claim 2 wherein said means consists of a tongue mounted on one wedge surface and a groove mounted on the other wedge surface, the tongue and groove interlocking the wedge portions together.

4. The sanding block as claimed in claim 1 wherein the sides of said sanding block define elongated slots to receive the thumb and fingers of the user.

5. The sanding block as claimed in claim 1 wherein the wedge surface has a plurality of cavites.

* * * * *

UNITED STATES PATENT AND TRADEMARK OFFICE

CERTIFICATE OF CORRECTION

PATENT NO. : 6,213,857 B1
DATED : April 10, 2001
INVENTOR(S) : David M. Duquette It is certified that error appears in the above-identified patent and that said Letters Patent is hereby corrected as shown below:

Column 1,
Line 51, change "disdoses" to -- discloses --

Column 2,
Line 23, change "disdosed" to -- disclosed --
Line 29, change "are" to -- is --
Line 30, change "related" to -- relate --
Line 31, change "outside" to -- the outside --
Line 31, change "are" to -- area --

Column 3,
Line 2; change "convexdy" to -- convexly --

Column 4,
Line 14, change "porting" to -- portion --
Line 14, change "sandina" to -- sanding --
Line 16, change "portin" to -- portion --
Line 16, change "contructed" to -- constructed --
Line 17, change "such that when both such that when both" to -- such that when both --
Line 22, change "daimed" to -- claimed --
Line 32, change "cavites" to -- cavities --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*